US007976002B2

(12) United States Patent
Hoffmann et al.

(10) Patent No.: US 7,976,002 B2
(45) Date of Patent: Jul. 12, 2011

(54) GATHERER-STITCHER HAVING A FOLDED-SHEET FEEDER

(75) Inventors: Steffen Hoffmann, Leipzig (DE); Falk Preuss, Leipzig (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 660 days.

(21) Appl. No.: 11/732,078

(22) Filed: Apr. 2, 2007

(65) Prior Publication Data

US 2007/0228633 A1 Oct. 4, 2007

(30) Foreign Application Priority Data

Mar. 31, 2006 (DE) ..... 10 2006 015 464

(51) Int. Cl.
*B65H 39/00* (2006.01)

(52) U.S. Cl. ..... 270/52.23; 270/52.14; 270/52.16; 270/52.19; 270/52.2; 270/52.26; 270/52.29

(58) Field of Classification Search ..... 270/52.14, 270/52.16, 52.19, 52.2, 52.23, 52.24, 52.25, 270/52.26, 52.27, 52.28, 52.29
See application file for complete search history.

(56) References Cited

U.S. PATENT DOCUMENTS

| | | | | |
|---|---|---|---|---|
| 4,085,927 | A * | 4/1978 | Muller | 270/52.29 |
| 4,576,369 | A * | 3/1986 | Flensburg et al. | 270/52.17 |
| 4,625,952 | A | 12/1986 | Schniter | |
| 4,869,484 | A * | 9/1989 | Hastie | 270/52.27 |
| 5,067,700 | A * | 11/1991 | Dick | 270/52.29 |
| 5,292,111 | A * | 3/1994 | Hansch | 270/52.27 |
| 5,794,926 | A * | 8/1998 | Hansch | 270/52.26 |
| 6,003,859 | A * | 12/1999 | Reist | 271/204 |
| 6,015,145 | A | 1/2000 | Hartel | |
| 6,581,753 | B1 | 6/2003 | Brewster et al. | |
| 7,451,969 | B2 | 11/2008 | Böttcher et al. | |

FOREIGN PATENT DOCUMENTS

| | | | |
|---|---|---|---|
| DE | 9214606 | U1 | 12/1992 |
| DE | 103 21 327 | A1 | 12/2004 |
| EP | 0916514 | A1 | 5/1999 |
| EP | 0 976 672 | A2 | 2/2000 |
| EP | 1598210 | A1 | 11/2005 |
| GB | 1012970 | | 12/1965 |

* cited by examiner

*Primary Examiner* — Leslie A Nicholson, III
(74) *Attorney, Agent, or Firm* — Laurence A. Greenberg; Werner H. Stemer; Ralph E. Locher

(57) ABSTRACT

A gatherer-stitcher has a folded-sheet feeder and an apparatus for transferring folded sheets from the feeder to a transporting configuration of the gatherer-stitcher. The apparatus has a plurality of shafts or drums with grippers for gripping the folded sheets. The apparatus opens the folded sheets and places them astride the transporting configuration. The apparatus also has a blowing configuration which, as a folded sheet is transferred from one shaft or drum to another, subjects the folded sheet to a surge of air in time with a folded-sheet transportation.

10 Claims, 5 Drawing Sheets

GATHERER-STITCHER HAVING A FOLDED-SHEET FEEDER

CROSS-REFERENCE TO RELATED APPLICATION

This application claims the priority, under 35 U.S.C. §119, of German Patent Application DE 10 2006 015 464.9, filed Mar. 31, 2006; the prior application is herewith incorporated by reference in its entirety.

BACKGROUND OF THE INVENTION

Field of the Invention

The invention relates to a gatherer-stitcher having a folded-sheet feeder and an apparatus for transferring folded sheets from the feeder to a transporting configuration of the gatherer-stitcher. The apparatus has a plurality of shafts or drums with grippers for gripping the folded sheets. The apparatus opens the folded sheets and places them astride the transporting configuration.

Gatherer-stitchers or gang-stitchers serve to separate the folded and stacked-up printed products, to deposit them on a transporting chain or the like and, in the process, to collate folded products with different contents and feed them to a stitching station and subsequently, if appropriate, to a further-processing unit for edge trimming, to a delivery device, or the like. Such a gatherer-stitcher is described, for example, in European patent Application EP 0 916 514 A1. The known gatherer-stitcher has, as usual, a plurality of folded-sheet feeders which are disposed parallel to the collecting chain and in which the different folded sheets are stacked up.

A configuration is provided to remove the folded sheets from the folded-sheet feeders, open them up and place them in a straddling manner on the transporting chain of the gatherer-stitcher. The transporting chain is constructed in a manner similar to a roof ridge. That configuration usually includes a plurality of shafts or skeleton-like drums which are provided with grippers and cause the folded sheet to be transported from a register stop of the feeder to the collecting chain and to be opened up. The movement process which takes place there is complex and not always free of disruption, in particular if the gatherer-stitcher is operated at a high speed of 10,000 sheets per hour or above. That is because the folded sheets which are to be processed may be stacked in the folded-sheet feeder both with an overfold and with an underfold. Having an overfold means that the upper part of the folded sheet projects beyond the lower part, while precisely the opposite is the case for the so-called underfold. Problems arise at high speeds in particular in the case of processing sheets with an overfold. That is because, in that case, the folded sheet received by the first transfer drum at the folded edge rests on the drum by way of its longer side. If it is then to be gripped at the fanned-out end by the next shaft or drum, the overlap grippers disposed on the second drum must grip over the entire folded product. However, since the overfold or the longer part of the folded sheet can spring upward when it comes into contact with the opening double gripper, or "remain stuck" to the separating drum as a result of electrostatic effects, that results in the overlap grippers being "inserted into the folded product" instead of gripping over it as a whole. That disrupts transportation, and reliable processing at high speeds is not possible.

SUMMARY OF THE INVENTION

It is accordingly an object of the invention to provide a gatherer-stitcher having a folded-sheet feeder, which overcomes the hereinafore-mentioned disadvantages of the heretofore-known devices of this general type and in which an apparatus for transferring folded sheets from the feeder to a transporting configuration of the gatherer-stitcher, i.e. usually to a collecting chain, is constructed in such a way that folded sheets with an overfold are transferred more reliably at high speeds.

With the foregoing and other objects in view there is provided, in accordance with the invention, a gatherer-stitcher, comprising a folded-sheet feeder, a transporting configuration, and an apparatus for transferring folded sheets from the feeder to the transporting configuration. The apparatus has a plurality of shafts or drums with grippers for gripping the folded sheets. The apparatus opens the folded sheets and places the folded sheets astride the transporting configuration. The apparatus has a blowing configuration subjecting a folded sheet to a surge of air in time with a folded-sheet transportation, as the folded sheet is transferred from one shaft or drum to another. This prevents the folded sheet from fanning out at the time of transfer to the next transporting drum. Instead, the overfold is placed on this following drum and the overlap gripper also actually grips over it.

In accordance with concomitant features of the invention, for this purpose, it is possible, for example, for the first drum, which is usually a half-revolution drum and receives the folded sheet from the register stop of the folded-sheet feeder, to have a respective blowing tube which is disposed in the vicinity of the fanning-out side of the folded product and of which the nozzles generate an outwardly directed air stream. This air stream is preferably directed obliquely, at an acute angle, onto the fanning-out side of the folded sheet and is switched cyclically, in time with the sheet feeding, at the time of transfer to the next transporting drum.

Other features which are considered as characteristic for the invention are set forth in the appended claims.

Although the invention is illustrated and described herein as embodied in a gatherer-stitcher having a folded-sheet feeder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
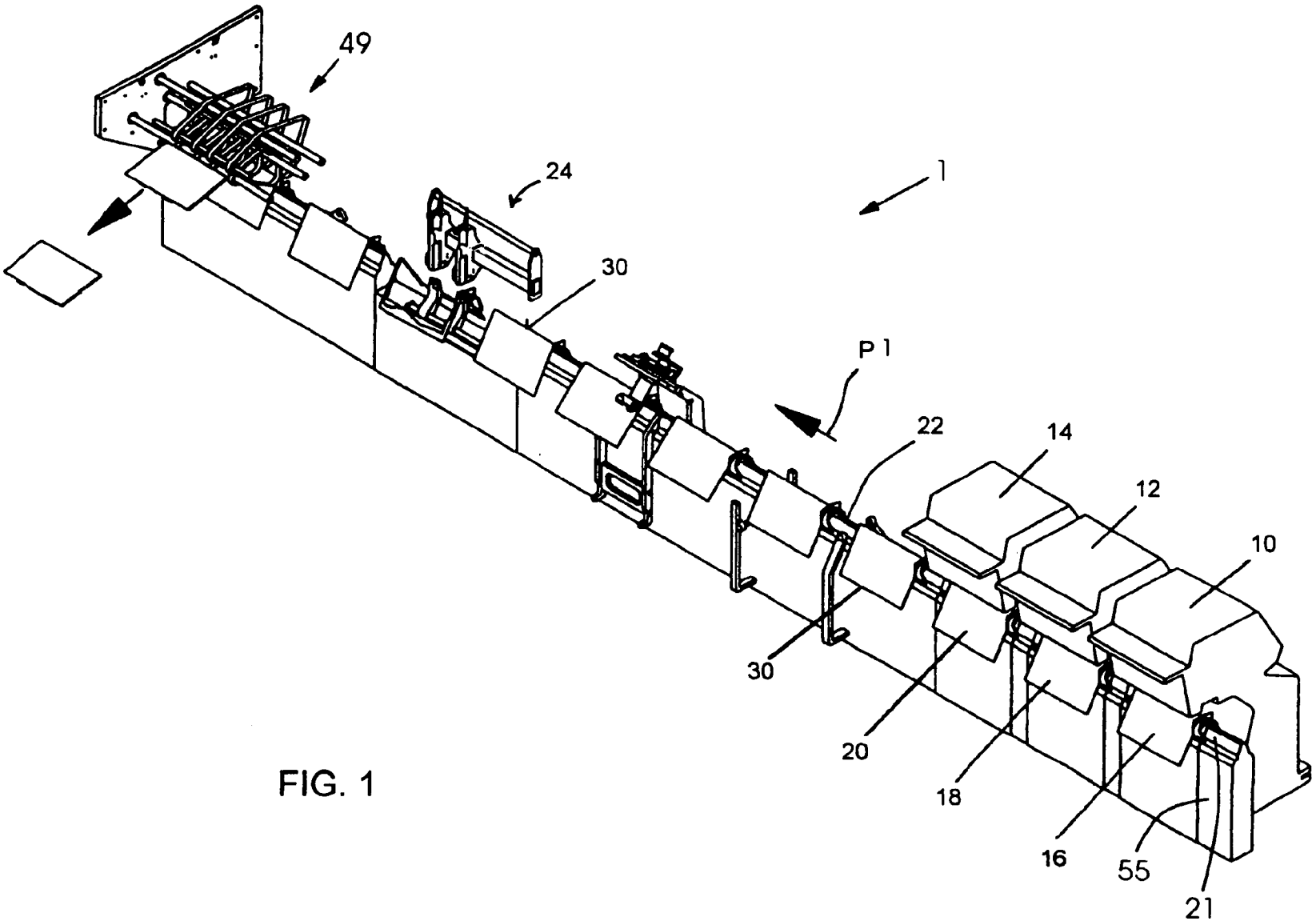
FIG. 1 is a simplified, diagrammatic, perspective view of a gatherer-stitcher having a plurality of folded-sheet feeders.

Referring now to the figures of the drawings in detail and first, particularly, to FIG. 1 thereof, there is seen a typical gatherer-stitcher or gang-stitcher 1 having a collecting chain 22 as a transporting configuration. Individual folded sheets or folded signatures 16, 18, 20 from stacks in folded-sheet feeders 10, 12, 14 are deposited on this collecting chain. Disposed beneath the collecting chain 22 is a guide strip 55, which has an upper portion 21 formed in the manner of a knife edge and which has a straight line defining a transporting and stitching line. The collecting chain 22, together with the guide strip 55, forms a substantially roof-like rest on which the collected folded sheets 30 are transported in a straddling manner or astride, in the direction of an arrow P1, to a stitching station 24, in which they are stitched with the aid of wire staples. The folded product which has been stitched in this way is then fed by a configuration 49, at right angles to the transporting direction of the collecting chain, to a further-processing configuration, for example an edge-trimming configuration.

Figure 2:
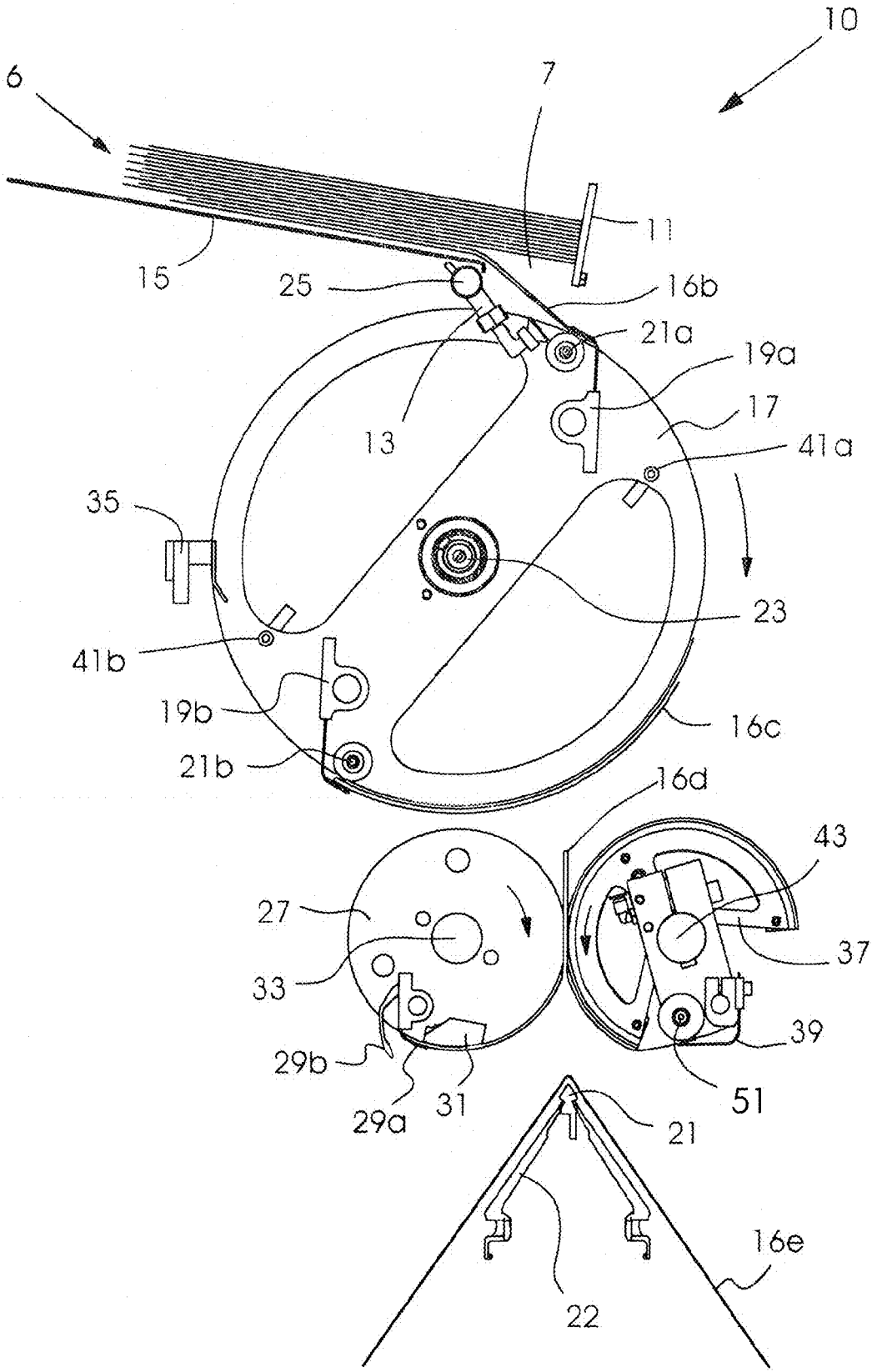
FIGS. 2 to 6 are enlarged, side-elevational views of a region between a folded-sheet feeder and a transporting chain of the gatherer-stitcher of FIG. 1, as seen in a section perpendicular to a transporting direction.

FIG. 2 shows, in a section perpendicular to the transporting direction, a region beneath the folded-sheet feeder 10 between a register rail 11, against which the folded sheets 16 rest by way of their folded-over end, and the collecting chain 22.

A half-revolution, so-called separating drum 17, is disposed directly beneath a base 15 of a compartment in the feeder 10 containing a folded-sheet stack 6. The drum 17 has two symmetrically opposite grippers 19*a* and 19*b* and gripper rests 21*a* and 21*b*, as seen in relation to a drive shaft 23 of the drum 17. A rotatable hollow shaft 25, on which a plurality of suction grippers 13 are fastened and distributed in axial direction, is also disposed on the base 15 of the feeder 10, parallel to the axis 23 of the drum 17. A respectively lowermost folded sheet 16*b* butting against the register rail 11 with its folded end, is gripped by suction attachment through the use of the suction grippers 13, and then has its folded end drawn through a relatively wide slot between a rounded end of the base 15 and the register rail 11 and into the periphery of the separating drum 17 by way of a pivoting movement of the suction gripper 13. The separating drum 17 rotates in the clockwise direction and the pairs of grippers 19*a* and 19*b* open and close in a cam-controlled manner and receive the folded end of the folded sheet 16*b* offered to them by the suction gripper 13, in which case they draw the folded sheet out of the stack 6. FIG. 2 shows how a folded sheet 16*b* has just been received by the gripper 19*a*, while a folded sheet 16*c*, which was transferred at an earlier point in time, is retained by the gripper 19*b* and is still located on the outer periphery of the separating drum 17.

Figure 3:
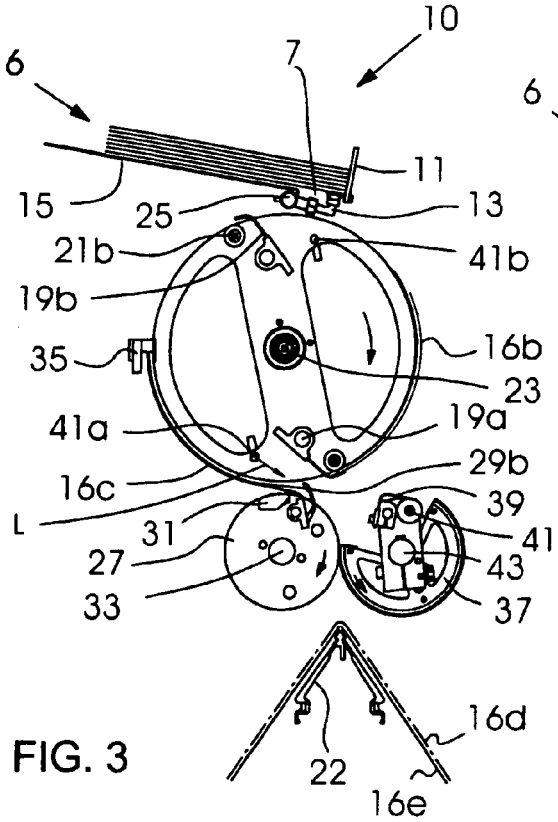

Two single-revolution shafts or drums 27 and 37 are located directly one beside the other beneath the half-revolution separating drum 17. The so-called double-gripper drum 27 and opener drum 37 form an interstice, beneath which the transporting chain 22 of the gatherer-stitcher 1 is disposed with a roof-edge peak upward. The double-gripper drum 27 and the opener drum 37 are used, as is illustrated in FIG. 2 by way of a folded sheet 16*d*, to open the folded sheet 16*d* and place it on a folded sheet 16*e*, which has already been transported up by the collecting chain 22. For this purpose, the double-gripper drum 27 is provided in the axial direction with a plurality of double grippers 29*a*, 29*b*. The individual grippers 29*a* and 29*b* of the respective double gripper are intended to grip two parts of the folded sheet 16 individually at their fanned-out end and draw off the same from the separating drum 17. This situation is illustrated in FIG. 3, where the gripper 29*a* has already gripped the underfold end of the folded sheet 16*c* while the so-called covering gripper 29*b*, which grips over the entire folded sheet, is illustrated during its closing movement as it grips the overfold. At this point in time, the gripper 19*b* on the separating drum has opened and released the folded sheet 16*c*, which has run into a fixed pocket-like stop 35 with its folded end. Furthermore, precisely the same folded sheet 16*b* which in FIG. 2 is transferred from the suction gripper 13 is conveyed further by the gripper 19*a* in the direction of the drums 27 and 37.

Figure 4:
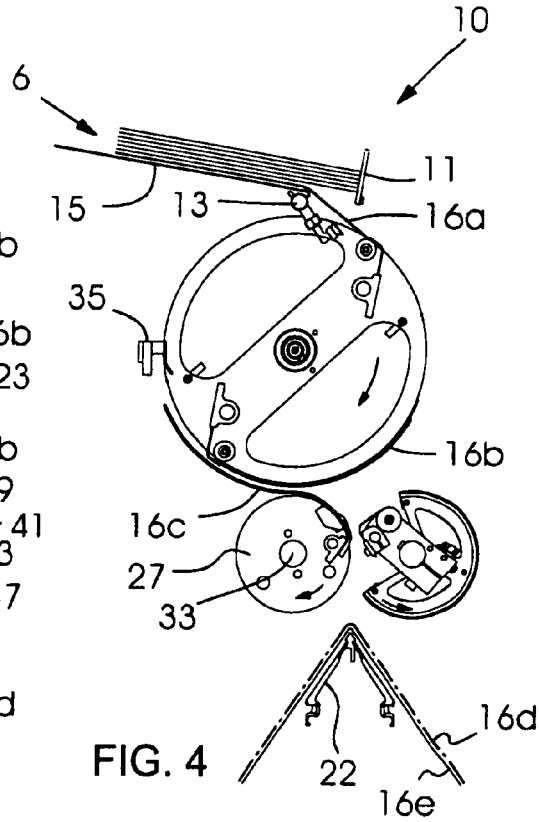
Figure 5:
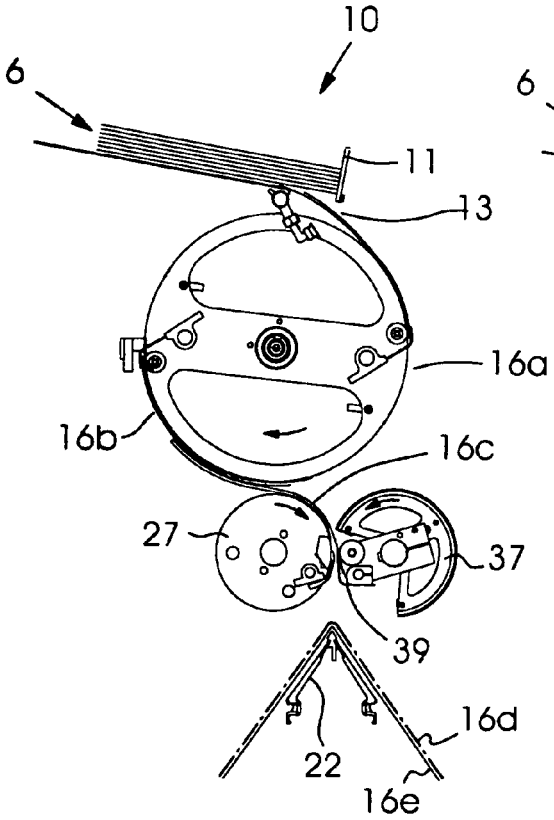

FIG. 4 illustrates how those ends of the folded product 16*c* which are gripped by the double gripper 29 are conveyed into the interstice between the two drums 27 and 37. In this case, the folded sheet 16*c* is drawn out of the pocket 35 and moved in the opposite direction beyond the next incoming folded sheet 16*b*. The covering gripper 29*b* on the drum 27 then opens and transfers the longer overfold to a gripper 39 of the opener drum 37 having a gripper rest 51 seen in FIG. 5. At the same time, the gripper 19*a* on the separating drum 17 has conveyed the folded sheet 16*b* into the pocket-like stop 15 and the gripper 19*b* has drawn off the next folded sheet 16*a* from the stack 16.

Figure 6:
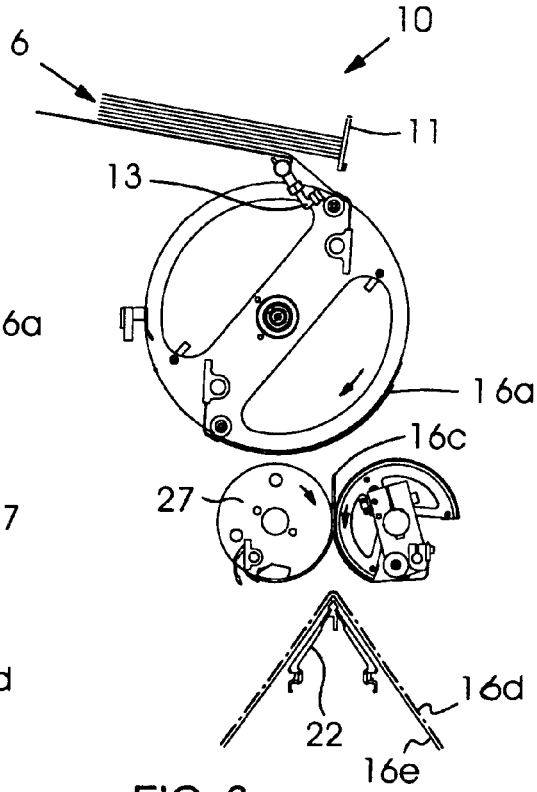

The folded sheet 16*c* is then spread apart over the transporting chain 22 by virtue of the drums 27 and 37 being rotated in opposite directions, as can be seen in FIG. 6, which corresponds to the illustration in FIG. 2 as far as the point in time for movement purposes is concerned.

Figure 7:
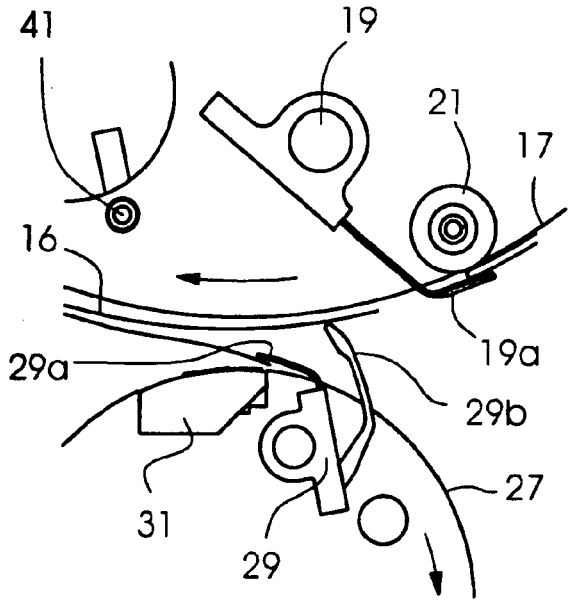
FIGS. 7 to 10 are further enlarged, side-elevational views of a region of sheet transfer from a separating drum to a double-gripper drum of FIG. 2.
Figure 8:
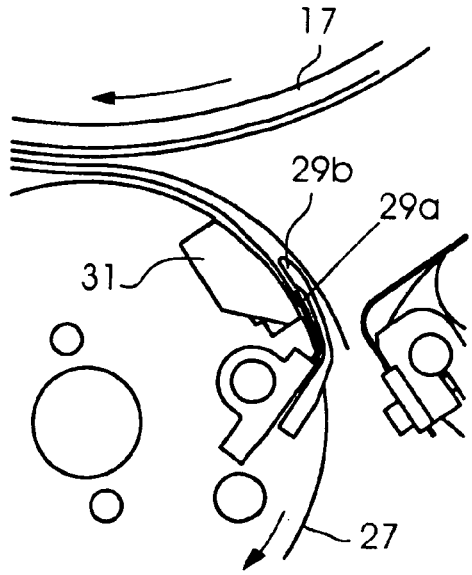

In the processing of sheets with an overfold, i.e. those in which, as illustrated in FIGS. 2 to 6, the longer part of the folded sheet 16 is on top and (since the folded sheets are stacked up "the other way around" in the feeder 10) the longer side rests on the base 15 of the feeder 10, problems arise at high speeds during transfer of the folded sheets from the separating drum 17 to the double-gripper drum 27. This is illustrated in FIG. 7. It can be seen herein how the opening double gripper 29 raises the overfold up from the double-gripper drum 27. This then results in the overfold not being gripped when the covering gripper 29*b* closes. As movement continues in the direction of the interstice with the opener drum 37, the overfold is in an undefined position and the gripper 39 of the opener drum possibly misses the overfold, so that the opener drum 37 then cannot open the folded sheet out above the transporting chain 22. This sheet then lands alongside the chain 22 and the corresponding folded product lacks the appropriate pages.

Figure 9:
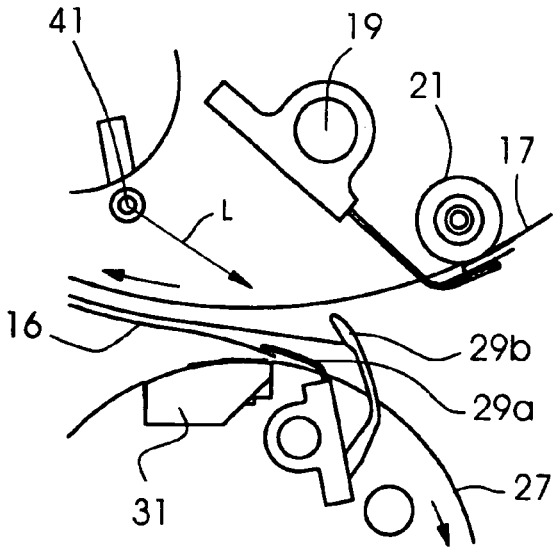
Figure 10:
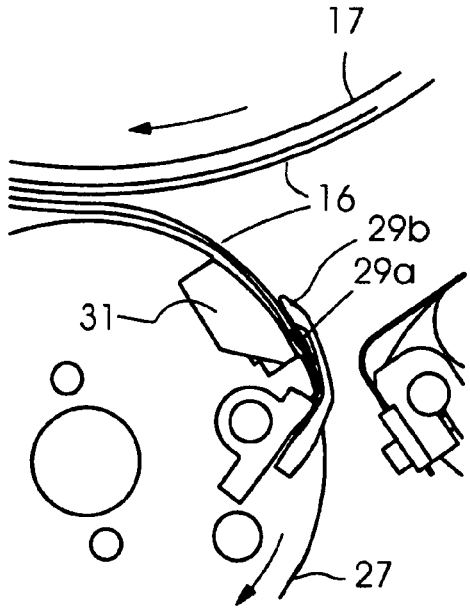

Furthermore, the overfold may remain stuck to the separating drum as a result of electrostatic effects, in which case it is not gripped by the covering gripper 29*b*. In order to avoid this, the separating drum 17 has two blowing tubes 41*a* and 41*b* on its outer periphery, in the vicinity of the locations where transfer to the double-gripper drum takes place. As can be seen in the illustration according to FIG. 11, these blowing tubes have a multiplicity of nozzles which, as is symbolized by an arrow L in FIG. 3 and in FIG. 9, at the time or timing or cycle of transfer to the double-gripper drum, direct an outwardly oriented surge of blowing air obliquely, at an acute angle, onto the overfold and thus force the latter back onto the double-gripper drum 17, so that it can be reliably gripped there by the covering gripper 19*b*.

Figure 11:
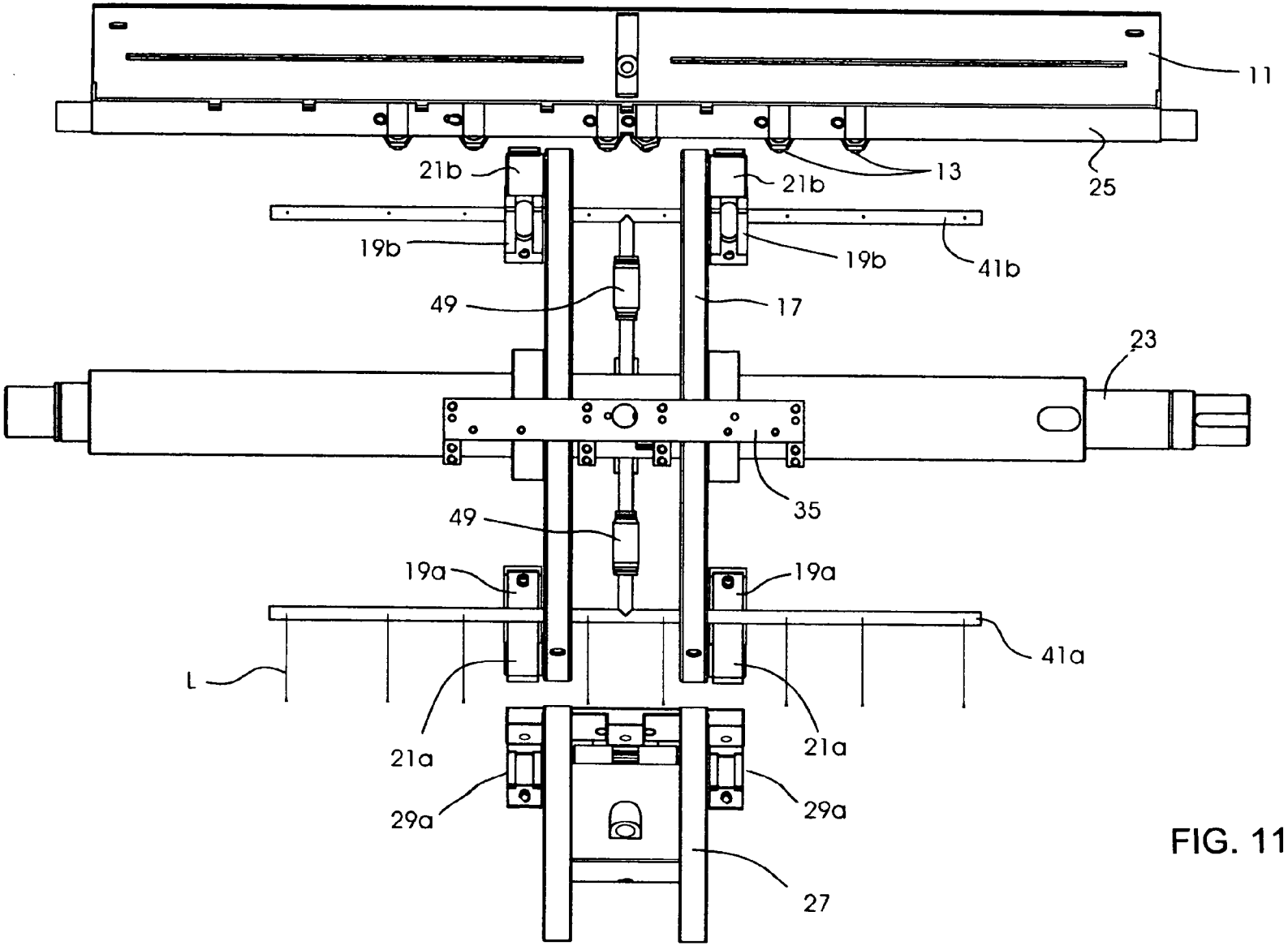
FIG. 11 is a front-elevational view of drums of FIGS. 2 to 6 as seen in the horizontal direction perpendicular to the transporting direction.

The blowing tubes 41*a* and 41*b* are supplied through compressed-air connections 49 shown in FIG. 11, which are connected to an air-feed bore made axially in journals of the separating drum 17. A rotary lead-through formed on the journals connects the bore to an electropneumatic quick-action valve which is activated by a control device of the gatherer-stitcher, or is connected to this control device.

The illustrated structure according to the invention reliably prevents the overfold from springing upward during transfer to the double-gripper drum 27. This means that sheets with an overfold are no longer "lost" at high speeds of the gatherer-stitcher 1.

We claim:

1. A gatherer-stitcher, comprising:

a folded-sheet feeder;

a transporting configuration; and an apparatus for transferring folded sheets from said feeder to said transporting configuration;

said apparatus having a plurality of shafts or drums with grippers for gripping the folded sheets;

said apparatus opening the folded sheets and placing the folded sheets astride said transporting configuration;

said apparatus having a blowing configuration subjecting a folded sheet to a surge of air in time with a folded-sheet transportation, as the folded sheet is transferred from one shaft or drum to another, to ensure that the folded sheet is not missed by at least one of said grippers, said blowing configuration including nozzles rotating with one of said shafts or drums; and said blowing configuration being configured to direct said surge of air obliquely onto an overfold of the folded sheet and force said overfold onto at least one of said grippers.

2. The gatherer-stitcher according to claim 1, wherein one of said shafts or drums has at least one blowing tube of said blowing configuration, said at least one blowing tube rotating along with said one shaft or drum and being disposed in vicinity of a fanning-out end of the folded sheet transported on said one shaft or drum.

3. The gatherer-stitcher according to claim 2, wherein said at least one blowing tube is disposed in an interior of a contour of said one shaft or drum defined by the folded sheet resting thereon, and said at least one blowing tube has nozzles generating an outwardly directed air stream.

4. The gatherer-stitcher according to claim 3, wherein said air stream is directed obliquely, at an acute angle, onto the fanning-out end of the folded sheet.

5. The gatherer-stitcher according to claim 1, wherein one of said shafts or drums is a half-revolution shaft or drum containing two blowing tubes of said blowing configuration.

6. The gatherer-stitcher according to claim 1, wherein one of said shafts or drums receives the folded sheets from said folded-sheet feeder, and said blowing configuration is disposed in said one shaft or drum.

7. The gatherer-stitcher according to claim 1, wherein said blowing configuration is supplied with compressed air through a journal of one of said shafts or drums.

8. The gatherer-stitcher according to claim 1, wherein said blowing configuration includes means for subjecting the folded sheet to the surge of air in time with the folded-sheet transportation, as the folded sheet is transferred from one shaft or drum to another.

9. The gatherer-stitcher according to claim 1, wherein said blowing configuration is configured to subject the folded sheet to the surge of air in time with the folded-sheet transportation, as the folded sheet is transferred from one shaft or drum to another.

10. A method for operating a gatherer-stitcher, the method comprising the following steps:

transferring folded sheets from a folded-sheet feeder to a transporting configuration with a transfer apparatus;

gripping the folded sheets with grippers of a plurality of shafts or drums of the transfer apparatus;

opening the folded sheets and placing the folded sheets astride the transporting configuration with the transfer apparatus;

subjecting a folded sheet to a surge of air in time with a folded-sheet transportation using a blowing configuration of the transfer apparatus, as the folded sheet is transferred from one shaft or drum to another, ensuring that the folded sheet is not missed by at least one of the grippers, the blowing configuration having nozzles rotating with one of the shafts or drums; and said blowing configuration being configured to direct said surge of air obliquely onto an overfold of the folded sheet and force said overfold onto at least one of said grippers.

* * * * *